US005438734A

United States Patent [19]

Anderson

[11] Patent Number: 5,438,734

[45] Date of Patent: Aug. 8, 1995

[54] BELT AND BUCKLE COMBINATION INCLUDING DUAL RING FASTENER

[75] Inventor: James R. Anderson, Menominee, Mich.

[73] Assignee: Evergreen Tool Company, Inc., Menominee, Mich.

[21] Appl. No.: 234,872

[22] Filed: Apr. 28, 1994

[51] Int. Cl.[6] ..... A44B 11/18

[52] U.S. Cl. ..... 24/170; 24/197

[58] Field of Search ..... 24/168, 170, 198, 191, 24/200, 193, 197

[56] References Cited

U.S. PATENT DOCUMENTS

| | | | |
|---|---|---|---|
| 228,534 | 6/1880 | Hudson et al. . | |
| 802,476 | 10/1905 | Ringhausen . | |
| 1,081,610 | 12/1913 | Hazard . | |
| 1,221,741 | 4/1917 | Johnson . | |
| 1,514,462 | 11/1924 | Ritter . | |
| 1,697,833 | 1/1929 | Lane . | |
| 1,781,078 | 11/1930 | Place . | |
| 1,963,271 | 6/1934 | Jensen . | |
| 2,057,575 | 10/1936 | Houghton | 24/197 |
| 3,121,270 | 2/1964 | Van Den Broek et al. . | |
| 4,470,176 | 9/1984 | Vermeulen et al. . | |
| 4,627,132 | 12/1986 | Markham | 24/169 |
| 4,670,945 | 6/1987 | Banks | 24/197 X |

*Primary Examiner*—James R. Brittain
*Attorney, Agent, or Firm*—Michael, Best & Friedrich

[57] ABSTRACT

A belt and buckle combination including a flexible belt and a dual ring fastener comprising a pair of G-shaped rings each having a closed ring portion and an open ring portion. The belt includes a loop at one end that extends through the closed ring portions of the rings and an opposite free end that is threadable through the open ring portions of the rings to fasten the belt ends together. To unfasten the belt ends, the free belt end is slid through openings in the open ring portions without having to reverse the threading pattern of the belt through the rings.

17 Claims, 1 Drawing Sheet

BELT AND BUCKLE COMBINATION INCLUDING DUAL RING FASTENER

BACKGROUND OF THE INVENTION

1. Field of the Invention

The invention relates to releasable fastening devices, and more particularly to a belt and buckle combination in which the buckle includes a pair of rings.

2. Relation to Prior Art

A common fastener or buckle for lashing the ends of a belt together includes a pair of rings. A free end of the belt is threaded through both rings, turned upon itself, and passed again through only one of the rings so that pulling the free end tightens the belt.

An example of a dual ring fastener arrangement is illustrated in U.S. Pat. No. 1,697,833 issued Jan. 1, 1929, to Lane. That arrangement includes a strap having a closed loop at one end and a pair of D-shaped rings through which the loop extends. The other or free end of the strap can be threaded through the D-shaped rings to permit tightening of the strap when the free end is pulled. When tension is released from the belt, the free end can be drawn out of the D-shaped rings by reversing the threading pattern.

U.S. Pat. No. 3,121,270 issued Feb. 18, 1964, to Van Den Broek et al. relates to a fastening device for anchoring the ends of a strap under tension. The device consists of a pair of flat, G-shaped fastening elements that each include an open ring portion and a closed ring portion. In use, the G-shaped elements are placed in face-to-face, inverted relation to each other so that the open ring portion of one of the G-shaped elements overlays the closed ring portion of the other G-shaped element. To fasten one end of the strap to the G-shaped elements, that end is passed through the closed ring portion of one of the G-shaped elements and looped around a segment of the open ring portion of the other G-shaped element before being passed back through the closed ring portion of the former G-shaped element. The other end of the strap is threaded through the G-shaped elements in a similar manner. Thereafter, when the belt is tensioned, the ends are anchored in the G-shaped elements.

SUMMARY OF THE INVENTION

The invention provides a belt and buckle combination which is easily tightened and, when desired, readily released. The combination includes a buckle comprising a pair of rings. The rings are configured and arranged to cooperate with each other to permit the combination to be immediately fastened without threading a free end of the belt through both of the rings, to securely hold the belt in a tightened position, and to permit the combination to be immediately unfastened without drawing (a) the free end of the belt back through the rings, as is required in prior art arrangements.

More particularly, the invention provides a belt and buckle combination including a flexible strap or belt and a buckle comprising a pair of G-shaped rings. Each of the G-shaped rings includes a substantially closed ring portion through which one end of the belt is passed before being doubled back on itself to form a closed loop through both rings. In one embodiment of the invention, the loop is permanently closed so that the G-shaped rings are inseparable from the loop. Each G-shaped ring also includes an incomplete or open ring portion which can be engaged with a temporary loop at the free end of the belt to adjustably cinch the belt. Thereafter, when the free end of the belt is pulled, the belt is tightened. Thus, threading the free end of the belt through both of the G-shaped rings to fasten the cinch is not necessary. The open ring portions are configured so that during use the belt is held firmly and is prevented from sliding through the openings or gaps in the open ring portions to release the cinch on the belt. To quickly release that cinch, the belt is manually slidable through the gaps in the open ring portions. Thus, drawing the free end of the belt back through the G-shaped rings to unfasten the cinch is not necessary.

In a second embodiment of the invention, the G-shaped rings are arranged in mirror image relation to each other so that the gap in the open ring portion of each ring is at least partially closed by the other ring. In this arrangement, the belt is readily released from the rings preferably by sliding the belt through the gap in one of the rings and then pulling the free end of the belt back through the other of the rings. Thus, the cinch is again released without reversing the entire threading operation.

Other features and advantages of the invention will become apparent to those skilled in the art upon review of the following detailed description, claims and drawings.

Figure 1:
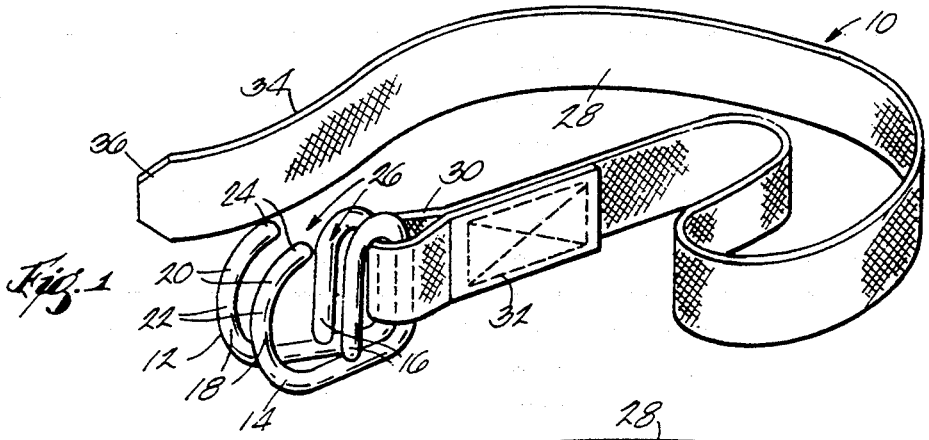
FIG. 1 is a perspective view of a belt and buckle combination embodying the invention and shown with the free end of the belt released from the rings.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF A PREFERRED EMBODIMENT

Figure 2:
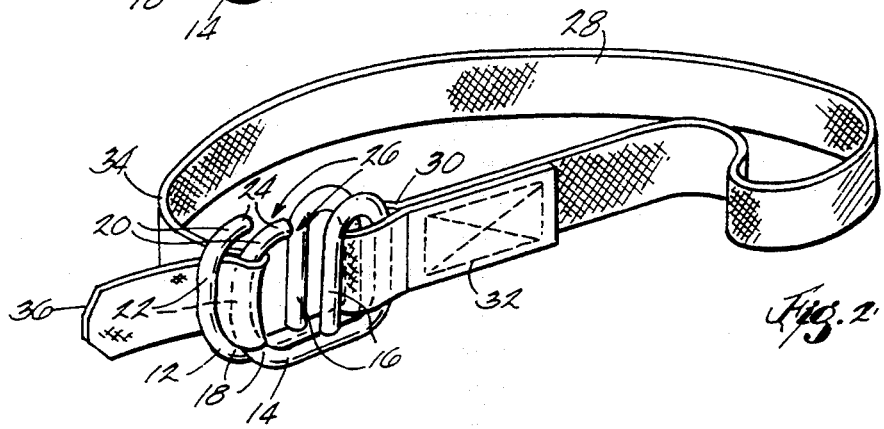
FIG. 2 is a view similar to FIG. 1, but showing the free end of the belt threaded through the rings.

Illustrated in FIGS. 1 and 2 is a belt and buckle combination 10 embodying the invention. The combination 10 comprises a pair of G-shaped rings 12 and 14 which can be formed, for example, by bending each of a pair of rods into a G-shape. In the illustrated arrangement the G-shaped rings 12 and 14 are identical and each includes a closed ring portion 16 and an incomplete or open ring portion 18. The open ring portions 18 of the rings 12 and 14 each include a semiannular ring segment 20 extending from the corresponding closed ring portion 16. Each ring segment 20 includes a bight or main portion 22 and a terminal end portion 24 that curves sharply back toward the corresponding closed ring portion 16 to provide an opening or gap 26 therebetween. As shown in FIGS. 1 and 2, the rings 12 and 14 are identically oriented and are positioned to substantially overlay each other so that the gaps 26 in the respective open ring portions 18 are substantially aligned.

The belt and buckle combination 10 also comprises a flexible strap or belt 28. The belt 28 is a one-piece member and includes a first end section 30 that extends through the closed ring portions 16 of both of the rings 12 and 14. The first end section 30 is doubled back on itself to form a loop and is fastened with stitches 32 to permanently close the loop. The rings 12 and 14 are thus inseparable therefrom. In other embodiments, the stitches 32 could be replaced with other permanent fastening means or with temporary fastening means if the ability to completely remove the rings 12 and 14 from the belt 28 is desired.

The belt 28 also includes a second end section 34 opposite the first end section 30. The second end section 34 has a free end 36 which is threadable through the open ring portions 18 (see FIG. 2) of the rings 12 and 14 to adjustably cinch the belt 28. Threading is immediately accomplished by doubling the second end section 34 back on itself to form a temporary loop, grasping the doubled back second end section 34 together with one hand between the temporary loop and the free end 36 to hold the temporary loop closed, inserting the terminal end portion 24 of the open ring portion 18 of the ring 14 into the temporary loop, and inserting the temporary loop between the ring 14 and the one hand through the gap 26 of the ring 12. Thereafter, when the free end 36 is pulled the belt 28 is tightened. Thus, the second end section 34 is inserted and cinched in the rings 12 and 14 without threading the free end 36 of the belt 28 through the open ring portions 18. When so secured, the curved terminal end portions 24 of the rings 12 and 14 prevent the belt 28 from sliding through the gaps 26.

To immediately unfasten the second end section 34 from the rings 12 and 14, the second end section 34 is slid through the aligned gaps 26 in the open ring portions 18 of the rings 12 and 14. Thus, the second end section 34 is separable from the rings 12 and 14 without (reversing the threading pattern and) drawing the free end 36 of the belt 28 back through the open ring portions 18.

Figure 3:
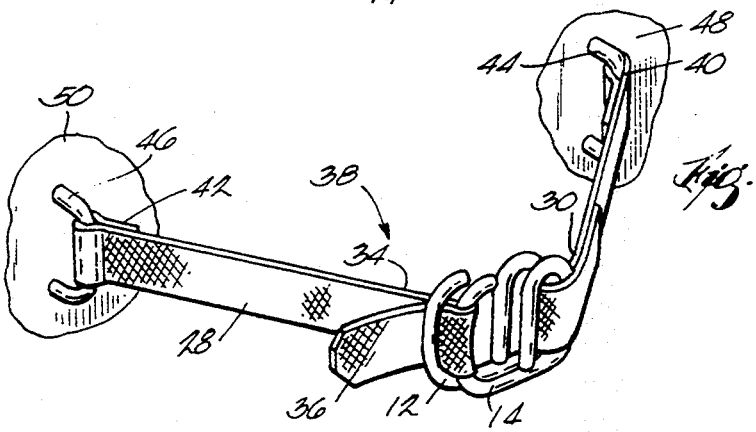
FIG. 3 is a perspective view of a belt and buckle combination in which the belt is modified to include two separate belt sections.

Illustrated in FIG. 3 is a belt and buckle combination 38 which is a modified version of the belt and buckle combination 10, and the same reference numerals are used for elements common to belt and buckle combinations 10 and 38. In belt and buckle combination 38 the belt 28 is a two-piece member, and the first and second end sections 30 and 34 are separated. As shown in FIG. 3, the first end section 30 is provided with a closed loop 40 at the end opposite the rings 12 and 14, and the second end section 34 is provided with a closed loop 42 opposite the free end 36. The closed loops 40 and 42 are attached to brackets 44 and 46, respectively, which are anchored in a pair of members 48 and 50 such as a tarp and a support surface for supporting an object (not shown) covered by the tarp, for example. By threading the free end 36 through the rings 12 and 14 as described above, the members 48 and 50 can be drawn toward one another and secured.

Figure 4:
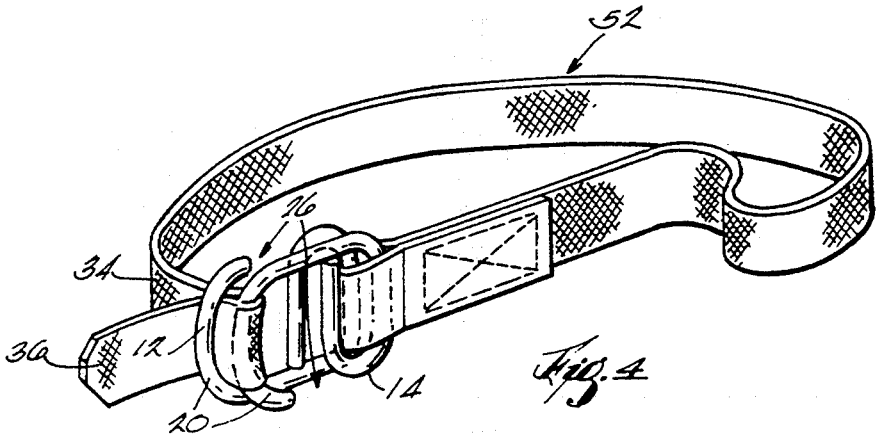
FIG. 4 is a perspective view of a belt and buckle combination in accordance with a second embodiment of the invention.

A belt and buckle combination 52 in accordance with a second embodiment of the invention is illustrated in FIG. 4 where the same reference numerals are used for elements common to the previous embodiment. In the second embodiment, the rings 12 and 14 are arranged in mirror image relation to each other so that the ring segment 20 of each ring at least partially closes the gap 26 in the other ring. Threading is accomplished by passing the free end 36 through the open ring portion 18 of ring 12, around the main portion 22 of ring 14, and back through the open ring portion 18 of ring 12. Thereafter, when the free end 36 is pulled the belt 28 is tightened. To unfasten the second end section 34 from the rings 12 and 14, the second end section 34 is slid off the ring segment 20 of ring 12, and the free end 36 is then drawn back through ring 14 to release the second end section 34.

Advantageously, the G-shaped rings 12 and 14 cooperate with each other to permit the second end portion 34 to be immediately threaded into the rings 12 and 14 and thereafter tightly cinched, to securely hold the belt 28 in a tightened position, and to permit a user to immediately unfasten the second end portion 34 from the rings 12 and 14 without drawing the free end 36 of the belt 28 back through both of the rings 12 and 14, as is required in prior art arrangements.

I claim:

1. A belt and buckle combination comprising a buckle including a pair of G-shaped rings, each of said rings including a closed ring portion, and an open ring portion, said open ring portion being semiannular to provide an opening therein, and a flexible belt including a first end section, said first end section forming a closed loop extending through said closed ring portions of said rings so that said rings are inseparable from said closed loop, and a second end section having a free end, said free end being threadable through said open ring portions of said rings so that when said second end section is pulled said belt is tightened, and said second end section thereafter being slidable through at least one of said openings in said open ring portions of said rings so that said second end section is separable from said rings without drawing said free end back through said open ring portion of both of said rings.

2. A belt and buckle combination as set forth in claim 1 wherein said rings are identically oriented and substantially overlay each other.

3. A belt and buckle combination as set forth in claim 1 wherein said rings are identical.

4. A belt and buckle combination as set forth in claim 1 wherein said belt is a one-piece member.

5. A belt and buckle combination as set forth in claim 1 wherein said open ring portion of each of said rings includes a semiannular ring segment extending from said closed ring portion of the respective one of said rings, said ring segment including a terminal end portion spaced from said closed ring portion of the respective one of said rings to provide said opening in said open ring portion of the respective one of said rings.

6. A belt and buckle combination as set forth in claim 5 wherein said rings are in mirror image relation to each other, and wherein said rings overlay each other so that said ring segment of each of said rings at least partially closes said opening in the other of said rings.

7. A belt and buckle combination as set forth in claim 1 wherein said second end section of said belt is slidable through said openings in both of said rings so that said free end of said second end section need not be drawn through said open ring portion of either of said rings to release said second end portion from said rings.

8. A belt and buckle combination comprising a pair of rings, each of said rings including a closed ring portion and an incomplete ring portion having an opening therein, and a flexible belt including a first end section, said first end section being fixed in a closed loop extending through said closed ring portion of each of said rings, and a second end section opposite said first end section, said second end section including a free end, and said second end section being threadable through said open ring portions so that tension on said free end tightens said belt, and said second end section being slidable through said openings in said open ring portions of said rings so that said second section is separable from said buckles without drawing said free end through said open ring portions of said rings.

9. A belt and buckle combination as set forth in claim 8 wherein said rings are identically oriented.

10. A belt and buckle combination as set forth in claim 8 wherein said rings are identical.

11. A belt and buckle combination as set forth in claim 8 wherein each of said rings is G-shaped, and wherein said rings are in mirror image relation to each other.

12. A belt and buckle combination as set forth in claim 8 wherein said belt is a one-piece member.

13. A belt and buckle combination as set forth in claim 8 wherein said open ring portion of each of said rings includes a semiannular ring segment extending from said closed ring portion of the respective one of said rings, said ring segment including a terminal end spaced from said closed ring portion of the respective one of said rings to provide said opening in said open ring portion of the respective one of said rings.

14. A belt and buckle combination as set forth in claim 13 wherein said rings are in mirror image relation to each other, and wherein said rings overlay each other so that said ring segment of each of said rings at least partially closes said opening in the other of said rings.

15. A belt and buckle combination comprising a buckle including a pair of identical G-shaped rings, each of said rings including a closed ring portion and an open ring portion, said open ring portion of each of said rings including a semiannular ring segment extending from said closed ring portion and including a terminal end portion spaced from said closed ring portion to provide an opening in said open ring portion, and a flexible belt including a first end section, said first end section forming a closed loop extending through said closed ring portions of said rings so that said rings are inseparable from said closed loop, and a second end section threadable through said open ring portions of said rings so that when said second end section is pulled said belt is tightened, and said second end section thereafter being slidable through at least one of said openings in said open ring portions of said rings so that said second end section is separable from said rings without drawing said free end back through said open ring portion of both of said rings.

16. A belt and buckle combination as set forth in claim 15 wherein said rings are identically oriented and substantially overlay each other.

17. A belt and buckle combination as set forth in claim 15 wherein said rings are in mirror image relation to each other, and wherein said rings overlay each other so that said ring segment of each of said rings at least partially closes said opening in the other of said rings.

* * * * *